US007069969B2

(12) United States Patent
Knappett et al.

(10) Patent No.: US 7,069,969 B2
(45) Date of Patent: Jul. 4, 2006

(54) WOOD CUTTING KNIFE ASSEMBLY PROVIDING IMPROVED KNIFE STABILITY

(75) Inventors: Andrew Knappett, Houston (CA); Brian J. Rusaw, House (CA); Peter J. Marshall, Sherwood, OR (US); Bradley R. Stager, Beaverton, OR (US); John S. Luecke, Milwaukie, OR (US)

(73) Assignee: Key Knife, Inc., Tualatin, OR (US)

( * ) Notice: Subject to any disclaimer, the term of this patent is extended or adjusted under 35 U.S.C. 154(b) by 114 days.

(21) Appl. No.: 10/672,989

(22) Filed: Sep. 25, 2003

(65) Prior Publication Data

US 2005/0067051 A1 Mar. 31, 2005

(51) Int. Cl.
*B27C 1/00* (2006.01)
*B27C 5/00* (2006.01)

(52) U.S. Cl. ..... 144/230; 144/241; 144/235; 144/176; 407/47; 407/49; 407/113

(58) Field of Classification Search ..... 144/241, 144/230, 232, 235, 176, 218, 162.1, 231; 241/92, 93, 296, 298, 294; 407/113, 40, 407/47, 41, 49, 107, 111
See application file for complete search history.

(56) References Cited

U.S. PATENT DOCUMENTS

| | | | | |
|---|---|---|---|---|
| 3,887,975 | A * | 6/1975 | Sorice et al. | 407/47 |
| 3,981,337 | A * | 9/1976 | Sundstrom | 144/241 |
| 4,047,670 | A * | 9/1977 | Svensson | 241/92 |
| 4,694,998 | A * | 9/1987 | McKinney | 242/550 |
| 4,850,408 | A | 7/1989 | Carpenter et al. | |
| 4,997,018 | A | 3/1991 | Carpenter et al. | |
| 5,271,440 | A | 12/1993 | Bradstreet | |
| 5,333,659 | A | 8/1994 | Carpenter et al. | |
| 5,348,065 | A | 9/1994 | Meyer | |
| 5,819,826 | A | 10/1998 | Schmatjen | |
| 5,979,522 | A * | 11/1999 | Swartwood et al. | 144/176 |
| 6,591,878 | B1 * | 7/2003 | Hinchliff | 144/241 |

FOREIGN PATENT DOCUMENTS

| | | |
|---|---|---|
| CA | 2079145 | 9/1992 |
| EP | 1329 295 A2 | 7/2003 |
| WO | WO 03/011541 A1 | 2/2003 |

* cited by examiner

*Primary Examiner*—Bena Miller
(74) *Attorney, Agent, or Firm*—Birdwell & Janke, LLP

(57) ABSTRACT

A wood chipping or cutting knife assembly providing improved knife stability. A number of control surfaces and other geometric features are provided to stabilize the knife in the assembly. An improved splitter is also provided for the knife assembly.

14 Claims, 11 Drawing Sheets

BOTTOM HEAD CUT

SIDE
HEAD CUT

TOP HEAD CUT

Fig. 17
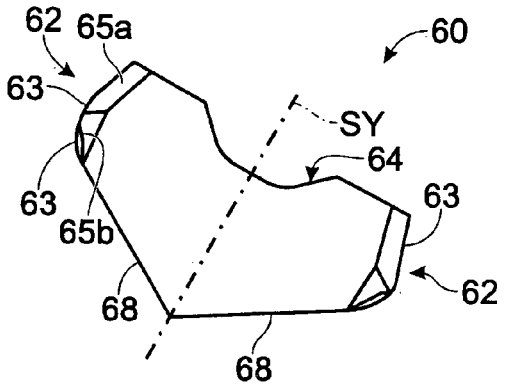
Fig. 19
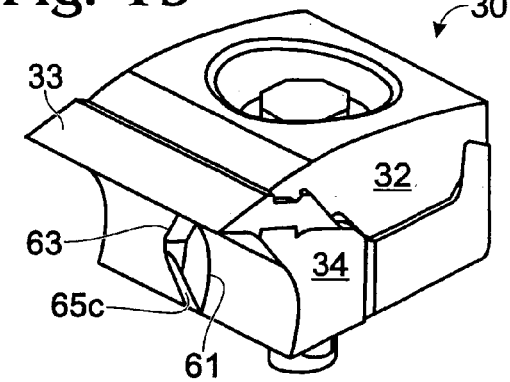
Fig. 18
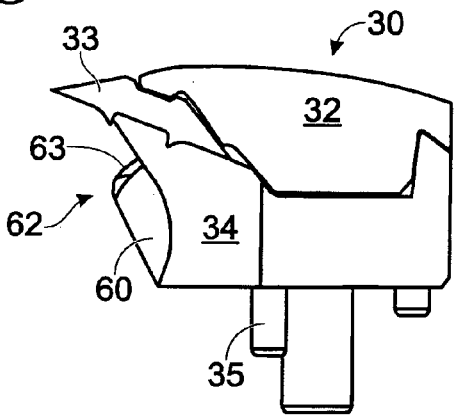
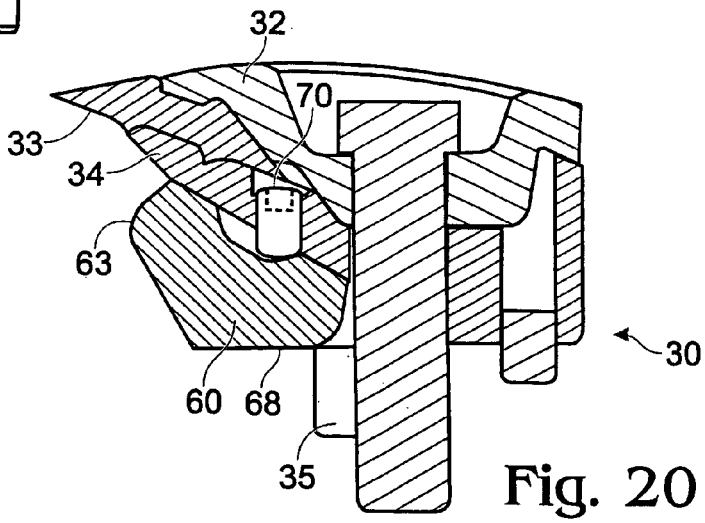
Fig. 20

WOOD CUTTING KNIFE ASSEMBLY PROVIDING IMPROVED KNIFE STABILITY

BACKGROUND OF THE INVENTION

The present invention relates to a wood cutting knife assembly providing improved knife stability, for use in wood processing.

Many kinds of wood cutting apparatus are used for processing logs, lumber, or wood refuse in a wood processing mill. For example, ring slicers, also termed ring flakers or stranders, are generally used for manufacturing particle board, oriented strand board, and fiberboard such as MDF. They convert logs, refuse lumber, chips, or other articles of wood into flakes, wafers or strands for the manufactured board products. Disc chippers are used to produce chips from waste wood, the chips also being used in manufactured wood products. Wood cutting apparatus having conical heads or drum style heads are used to produce squared lumber from logs.

All of these types of apparatus (hereinafter "wood cutting apparatus") employ removable knives that are exposed to large, highly episodic cutting forces over prolonged periods of time, yet the knives should be easily removable from the apparatus for maintenance, repair or replacement, and must be held in the apparatus in as stable a configuration as possible to produce high quality dimensioned lumber. It has proven difficult to meet all of these requirements.

A significant advance in the art of wood cutting knife assemblies is represented by Carpenter et al., U.S. Pat. No. 4,997,018, disclosing a knife assembly for use with the knife disclosed in Carpenter et al., U.S. Pat. No. 4,850,408. The knife is double-sided, i.e., has dual cutting edges, to provide a second, alternative cutting edge when the first cutting edge becomes worn or damaged. The knife includes a keyway for receiving a mating projection of a counterknife, the knife being clamped between the counterknife and an outer clamping member. The keyway and mating projection index the knife to the cutting apparatus to which the knife assembly is mounted, and positively secure the knife to the cutting apparatus.

More recently, Schmatjen, U.S. Pat. No. 5,819,826 discloses parallel ridges on the knife which straddle the projection of the counterknife. In addition to creating an effective keyway in the knife, the ridges deflect wood chips cut by the knife so as to reduce packing.

Bradstreet Jr. et al., U.S. Pat. No. 5,271,440, discloses a double-sided knife having a serrated surface for mating reception with a complementary serrated surface of, in this case, the outer clamping member. While apparently more difficult to manufacture than the aforementioned Carpenter et al. knife assembly, the assembly of Bradstreet Jr. et al. is like many in the prior art that are provided in recognition of the need to positively index and secure the knife to the cutting apparatus.

A further significant advance in the art of knife assemblies for use in wood cutting apparatus is represented in U.S. patent application Ser. No. 09/918,895 assigned to Key Knife Inc. The knife disclosed therein has deflector ridges on a front side of the knife to receive a mating projection of the counterknife in the manner of Schmatjen, U.S. Pat. No. 5,819,826, along with a recess in a back side of the knife to receive a mating projection from the outer clamping member of the clamping assembly. The counterknife is relieved and formed so that a definite "three-point" contact is made between the assembly and the knife comprising two points on the bottom surface of the knife and one point on the top surface of the knife. The two points of contact on the bottom surface of the knife are spaced as far apart as is practical, and the third point falls between these two points so that the knife is held in a stable configuration. Yet, the knife remains easy to remove from the assembly, and the complementary features provided in the outer clamping member and the knife actually improves the assembly in this regard.

So far as it is known, the prior art has not improved on this concept. However, the present inventors have recognized opportunities for further improving the stability of the knife in a knife assembly for use in wood cutting apparatus.

SUMMARY OF THE INVENTION

A wood chipping or cutting knife assembly providing improved knife stability according to a first aspect of the present invention provides a knife assembly for a wood cutting apparatus including a knife having a cutting edge and opposing front and back sides extending from the cutting edge, and an outer clamping member adapted to receive the back of side of the knife. The front side of the knife has a first interlocking feature and the back side of the knife has a second interlocking feature. The outer clamping member is adapted to receive the back side of the knife, and the outer clamping member has a third interlocking feature for interlocking with the second interlocking feature to index the knife to the outer clamping member. The second interlocking feature includes opposed first plane surfaces, and the third interlocking feature includes corresponding opposed second plane surfaces defining a second positive angle that is slightly greater than the first positive angle.

According to a second aspect of the invention, A knife for use in a knife assembly for a wood cutting apparatus is provided. The knife assembly includes a counterknife adapted for mounting to the apparatus and an outer clamping member adapted for mounting to the counterknife and for clamping the knife therebetween. The knife has an elongate axis and comprises two spaced apart cutting edges parallel to the elongate axis. The knife further includes opposing front and back sides extending between the cutting edges, the front side having a first interlocking feature for interlocking to the counterknife and the back side having a second interlocking feature for interlocking to the outer clamping member. The first interlocking feature includes a channel extending parallel to said elongate axis, and the second interlocking feature includes opposed spaced apart plane surfaces defining a positive angle therebetween.

According to a third aspect of the invention, a knife assembly for a wood cutting apparatus includes a knife and a counterknife. The knife has an elongate axis and comprises two spaced apart cutting edges parallel to the elongate axis. The knife further includes opposing front and back sides extending between the cutting edges, the front side having a pair of spaced apart deflector ridges extending parallel to the elongate axis and outwardly from the front side. The counterknife is adapted to receive the front side of the knife and to mount to the apparatus. The counterknife has an interlocking feature providing substantially full contact with the knife between the deflector ridges, to index the knife to the counterknife.

According to a fourth aspect of the invention, a knife assembly for clamping a knife to a rotating wood cutting apparatus is provided. The knife has a cutting edge and opposing front and back sides extending from the cutting edge. The knife assembly includes a counterknife adapted to receive the front side of the knife and to mount to the apparatus at a mounting point. The knife assembly further includes an outer clamping member adapted to receive the back side of the knife and to mount to the counterknife. The counterknife includes a first heel portion, and the outer clamping member includes a second heel portion corresponding to the first heel portion. The first heel portion is adapted to oppose the second heel portion substantially along a line that is at a positive angle with respect to the direction of travel of the knife.

According to a fifth aspect of the invention, a knife assembly for a rotating wood cutting apparatus includes a knife, a counterknife, and an outer clamping member. The knife has a cutting edge and opposing front and back sides extending from the cutting edge. The counterknife is adapted to receive the front side of the knife and to mount to the apparatus at a mounting point and includes a first heel portion. The outer clamping member is adapted to receive the back side of the knife and to mount to the counterknife and includes a second heel portion corresponding to the first heel portion. The first heel portion is adapted to oppose the second heel portion substantially along a line that is at a positive angle with respect to the direction of travel of the knife.

According to a sixth aspect of the invention, a wood cutting apparatus is provided including a rotating member for rotating about an axis of rotation, a knife, an outer clamping member, and a counterknife. The knife has a cutting edge and opposing front and back sides extending from the cutting edge. The front side has a first interlocking feature and the back side having a second interlocking feature. The outer clamping member is adapted to receive the back side of the knife, the outer clamping member having a third interlocking feature for interlocking with the second interlocking feature to index the knife to the outer clamping member. The second interlocking feature includes opposed first plane surfaces defining a first positive angle therebetween, wherein the third interlocking feature includes corresponding opposed second plane surfaces defining a second positive angle that is slightly greater than the first positive angle. The outer clamping member is adapted to mount to the counterknife. The counterknife is adapted to receive the front side of the knife and to mount to the rotating member. The counterknife has a fourth interlocking feature for interlocking with the first interlocking feature to index the knife to the counterknife.

According to a seventh aspect of the invention, a wood cutting apparatus is provided including a rotating member for rotating about an axis of rotation, a knife, and a counterknife.

The knife has an elongate axis and comprises two spaced apart cutting edges parallel to the elongate axis, and has opposing front and back sides extending between the cutting edges. The front side has a pair of spaced apart deflector ridges extending parallel to the elongate axis and outwardly from the front side. The counterknife is adapted to receive the front side of the knife and to mount to the rotating member. The counterknife has an interlocking feature providing substantially full contact with the knife between the deflector ridges, to index the knife to the counterknife.

According to an eighth aspect of the invention, a wood cutting apparatus is provided including a rotating member for rotating about an axis of rotation, a knife, a counterknife, and an outer clamping member. The knife has a cutting edge and opposing front and back sides extending from the cutting edge. The counterknife is adapted to receive the front side of the knife and to mount to the rotating member at a mounting point and includes a first heel portion. The outer clamping member is adapted to receive the back side of the knife and to mount to the counterknife. The outer clamping member includes a second heel portion corresponding to the first heel portion. The first heel portion is adapted to oppose the second heel portion substantially along a line that is at a positive angle with respect to the direction of travel of the knife.

According to a ninth aspect of the invention, a wood cutting apparatus includes a rotating member for rotating about an axis of rotation, a knife having a cutting edge, a counterknife for mounting the knife to the rotating member, and a splitter. The counterknife has a way disposed below the cutting edge and accessible from outside the apparatus, and the splitter is adapted for manual insertion and removal through the way. In one embodiment, the splitter has at least one splitting portion including a curvilinear splitting edge for splitting articles of wood cut by the knife. In another embodiment, the splitter has two splitting edges substantially symmetrically disposed about an axis of said splitter.

A tenth aspect of the invention provides a splitter for a knife assembly for a wood cutting apparatus. The knife assembly includes a knife having a cutting edge and a counterknife for mounting the knife to the apparatus. The counterknife has a way, and the splitter is adapted to fit in the way. In one embodiment, the splitter comprises at least one curvilinear splitting edge adapted for splitting articles of wood cut by the knife. In another embodiment, the splitter comprises two substantially symmetrically disposed splitting edges adapted for splitting articles of wood cut by the knife.

BRIEF DESCRIPTION OF THE DRAWINGS

FIG. 17 is a side view of a splitter according to the present invention.

FIG. 18 is a side elevation of a knife assembly according to the present invention incorporating the splitter of FIG. 17.

FIG. 19 is a pictorial view of the knife assembly of FIG. 18.

FIG. 20 is a side sectional view of the knife assembly of FIG. 18 with a lower portion of the counterknife removed.

DETAILED DESCRIPTION OF PREFERRED EMBODIMENTS

The present invention, directed generally to a wood cutting knife assembly providing improved knife stability, includes a number of aspects which are described separately for clarity. It is not essential to the invention to provide all aspects, or to provide any particular combination or subcombination of the aspects, the claims reciting the subject matter that the applicants regard as their invention.

Figure 1:
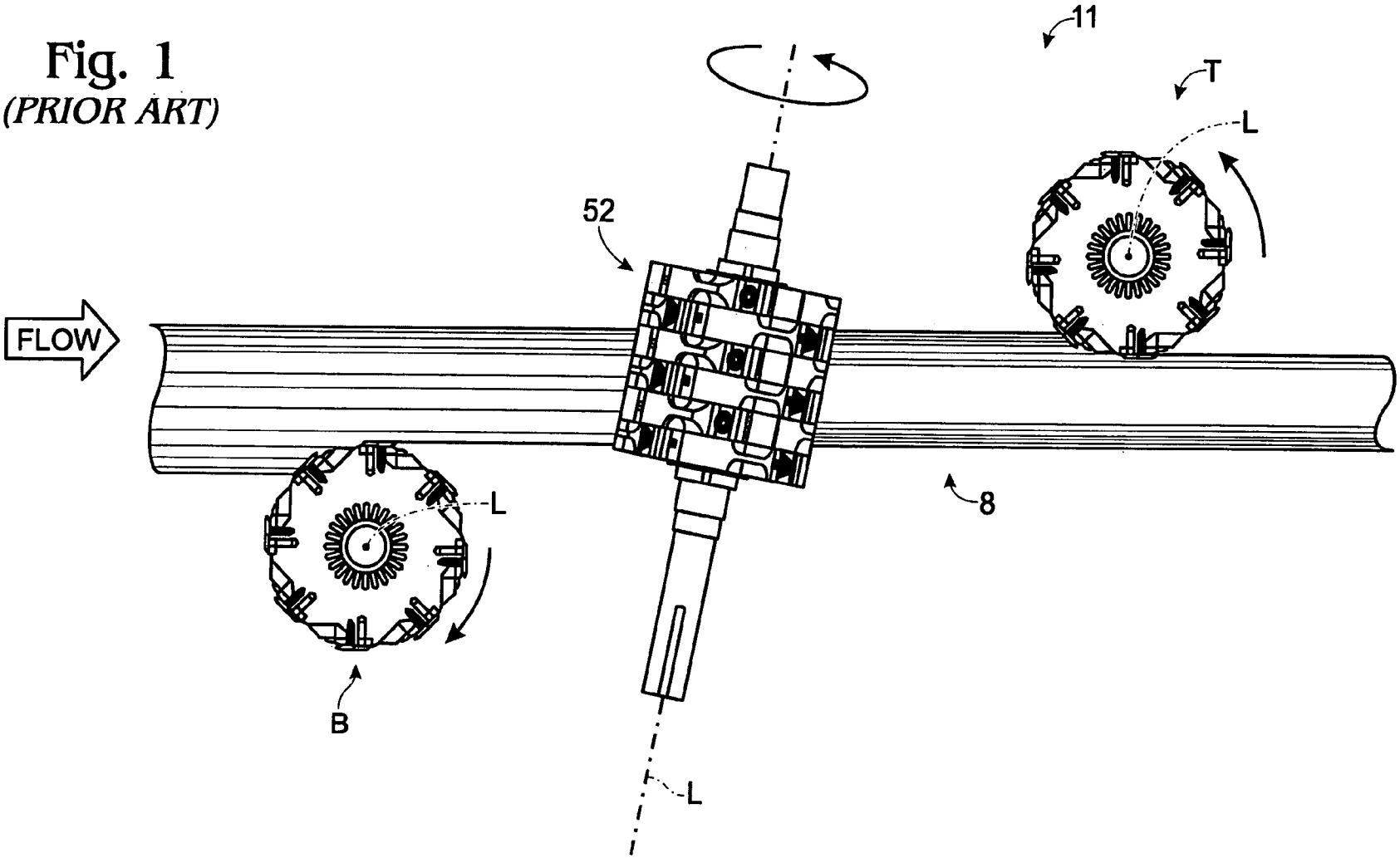
Fig. 1 (PRIOR ART)
FIG. 1 is a side elevation of a typical cutting apparatus for cutting an article of wood.
Figure 2A:
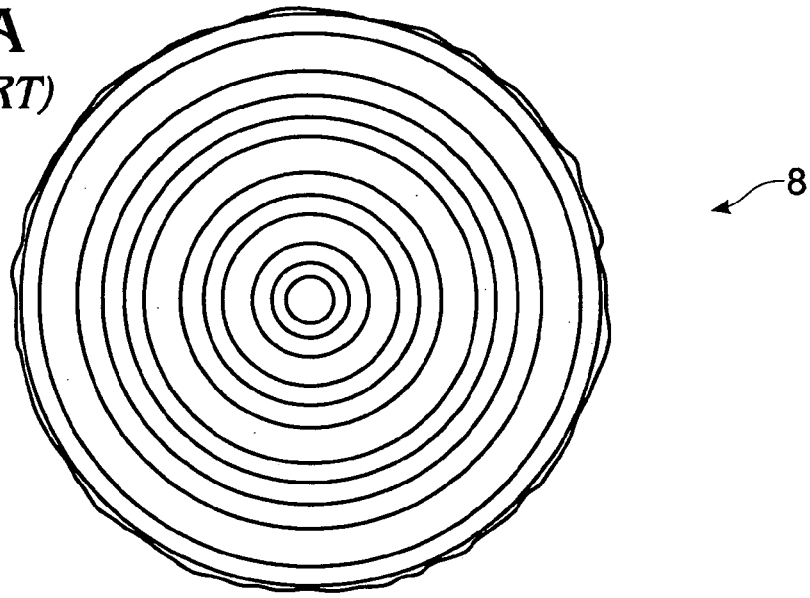
Fig. 2A (PRIOR ART)
FIG. 2A is a cross-sectional view of a typical article of wood.
Figure 2E:
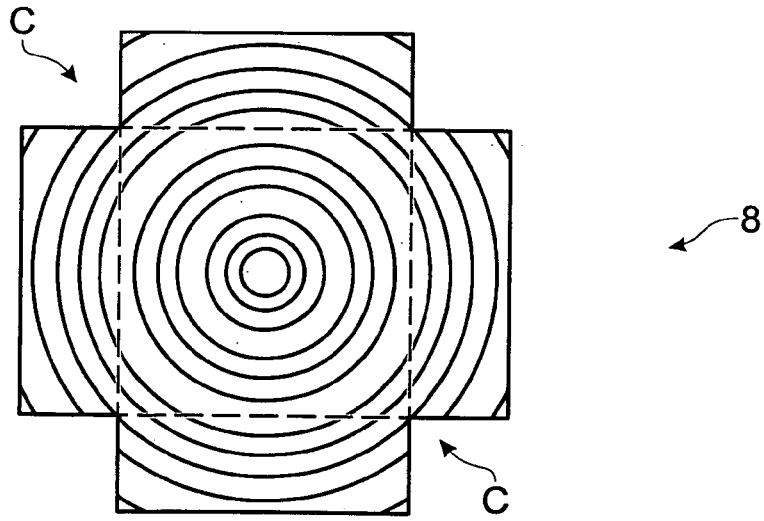
Fig. 2E (PRIOR ART)
FIG. 2E is a cross-sectional view of the article of wood of FIG. 2A with a corner cut by the apparatus of FIG. 3.
Figure 2B:
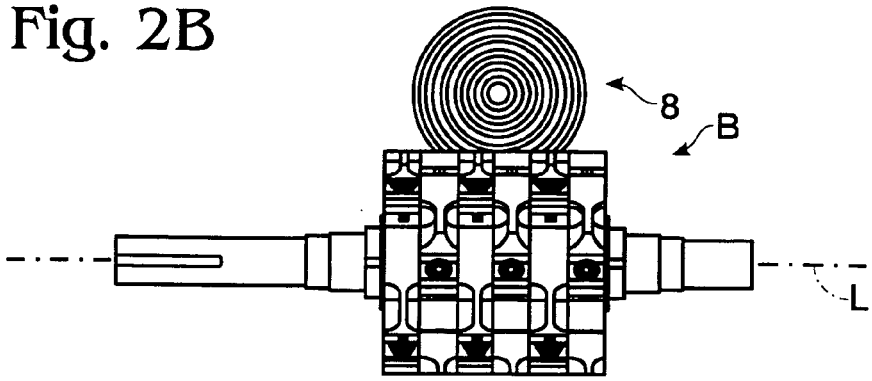
FIG. 2B is a cross-sectional view of the article of wood of FIG. 2A being cut by a bottom head of the cutting apparatus of FIG. 1.
Figure 2C:
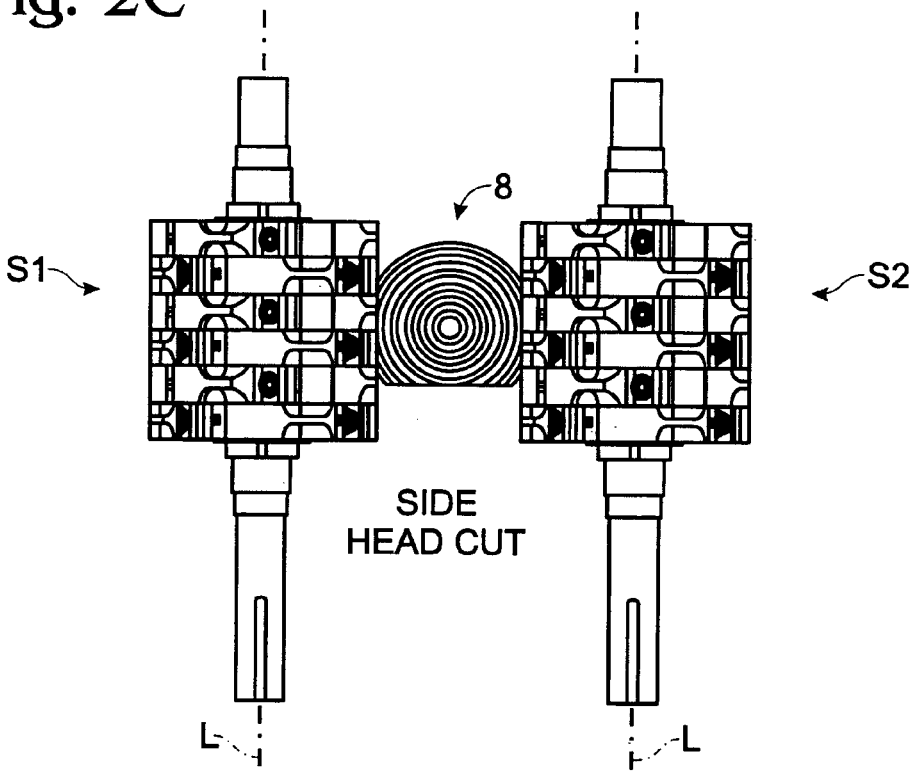
FIG. 2C is a cross-sectional view of the article of wood of FIG. 2A being cut by side heads of the cutting apparatus of FIG. 1.
Figure 2D:
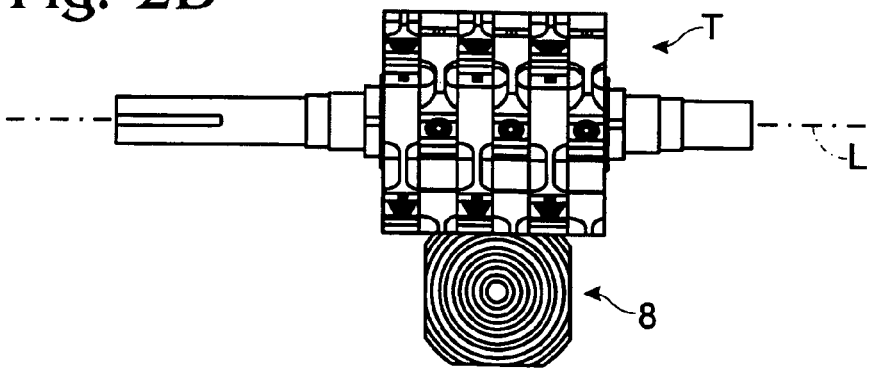
FIG. 2D is a cross-sectional view of the article of wood of FIG. 2A being cut by a top head of the cutting apparatus of FIG. 1.

For context, FIG. 1 shows a side elevation of a prior art wood cutting apparatus 11. FIGS. 2B–2D show the manner of cutting an article of wood 8 with the apparatus, here a log as shown in FIG. 2A. Heads B, T, S1 (FIG. 2C) and S2 rotate about respective axes of rotation "L." The bottom head B cuts a bottom side of the log, the top head T cuts a top side of the log, and side heads S1 and S2 cut corresponding sides of the log to square the log. It should be understood that the particular head geometry and construction shown is selected for illustration purposes only.

Figure 3:
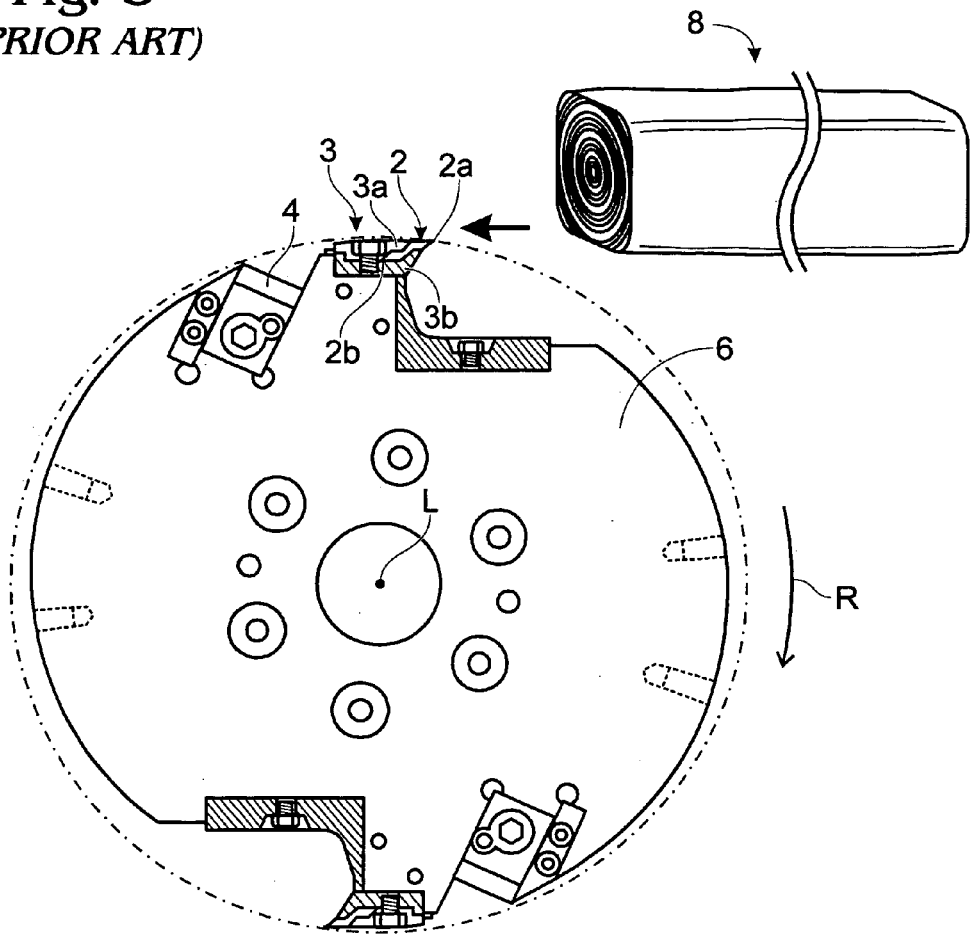
Fig. 3 (PRIOR ART)
FIG. 3 is a plan view of a typical disc used in the apparatus of FIG. 1.

Turning to FIG. 3, each head described above includes a plurality of stacked disc portions 6 (hereinafter "disc"), each disc supporting a plurality of knives 2. The knives 2 are held in knife assemblies 3 comprising outer and inner clamping members 3*a* and 3*b*, respectively, where the inner clamping member is often referred to as a "counterknife." Cutting edges 2*a* of the knives 2 are exposed for cutting the wood 8, the cutting edges extending along an axis that is perpendicular to the plane of the Figure. The knife assemblies are mounted to a rotating disc 6. The disc 6 and therefore the knives 2 rotate about an axis of rotation "L" that is also perpendicular to the plane of the Figure in a direction of rotation "R." The double-sided knives 2 also include cutting edges 2*b* that are not exposed unless the knives are removed and turned end-for-end. Additional knives 4 may also be provided with cutting edges parallel to the plane of the Figure so that, together, the knives 2 and 4 may cut corners in the wood 8. For example, if the article of wood 8 is a log as shown in FIGS. 2A, the knives 2 and 4 may be used to cut the corner C, as shown in FIG. 2E.

Figure 4:
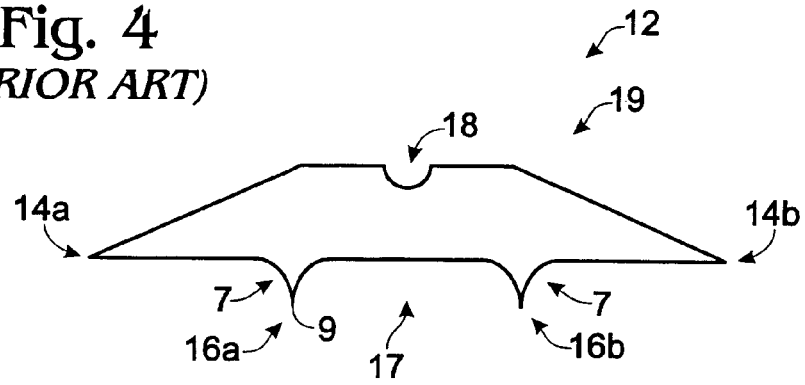
Fig. 4 (PRIOR ART)
FIG. 4 is a cross-sectional view of a prior art knife.

For comparison with the present invention, FIG. 4 shows a cross-sectional view of the prior art knife described in Schmatjen, U.S. Pat. No. 5,819,826 is shown. The knife is elongate with an elongate axis perpendicular to the plane of the Figure (not shown). The double-sided knife has two cutting edges 14*a*, 14*b*, two "deflector ridges" 16*a*, 16*b* on a front side 17 of the knife, and a semi-circular recess 18 on a back side 19 of the knife, which joins the front side 17 at the cutting edges 14*a* and 14*b*. The deflector ridges extend outwardly from the front side 17 and define a channel that provides an interlocking feature for interlocking with the counterknife.

This function could be provided by other structures, such as the keyway disclosed in U.S. Pat. No. 4,850,408. However, the deflector ridges also include concave curved outer surfaces 7 for deflecting wood chips from the counterknife, the outer surfaces 7 terminating in a line 9 which is seen as a point in the Figure.

Figure 5:
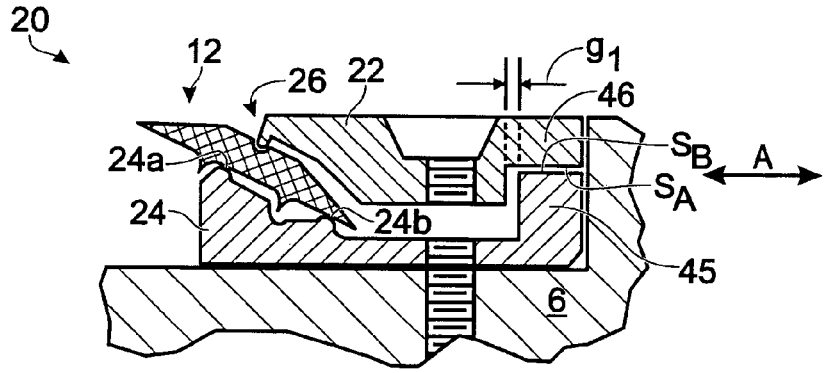
Fig. 5 (PRIOR ART)
FIG. 5 is a cross-sectional view of a knife assembly for clamping the knife of FIG. 4 so as to provide "three-point contact" with the knife

Also for comparison with the present invention, FIG. 5 shows a cross-sectional view of a knife assembly 20 for attachment to a disc 6, for clamping the knife 12 so as to provide "three-point contact" with the knife. The knife assembly 20 includes an outer clamping member 22 and an inner clamping member or counterknife 24. The counterknife 24 includes two lands 24*a* and 24*b* for making contact with the front side 17 (FIG. 4) of the knife 12, and is otherwise relieved so that no other contact is made with the knife. The upper clamping member includes a projection 26 that is received by the recess 18 (FIG. 4) of the knife, and is otherwise relieved so that no other contact is made with the knife.

The counterknife 24 includes a heel portion 45 that provides a backstop for a corresponding heel portion 46 of the outer clamping member 22. The heel portions 45 and 46 are spaced apart by a tolerancing gap $g_1$ in a circumferential direction "A" that is substantially parallel to the circumferential surface of the disc 6 in the local area of the counterknife (shown flat in FIG. 5 as an approximation), and are otherwise slidingly disposed with respect to one another by virtue of the angle of the opposed surfaces $S_A$ and $S_B$ of the respective heel portions so that limited relative movement of the counterknife and outer clamping member is possible along this direction.

Figure 6:
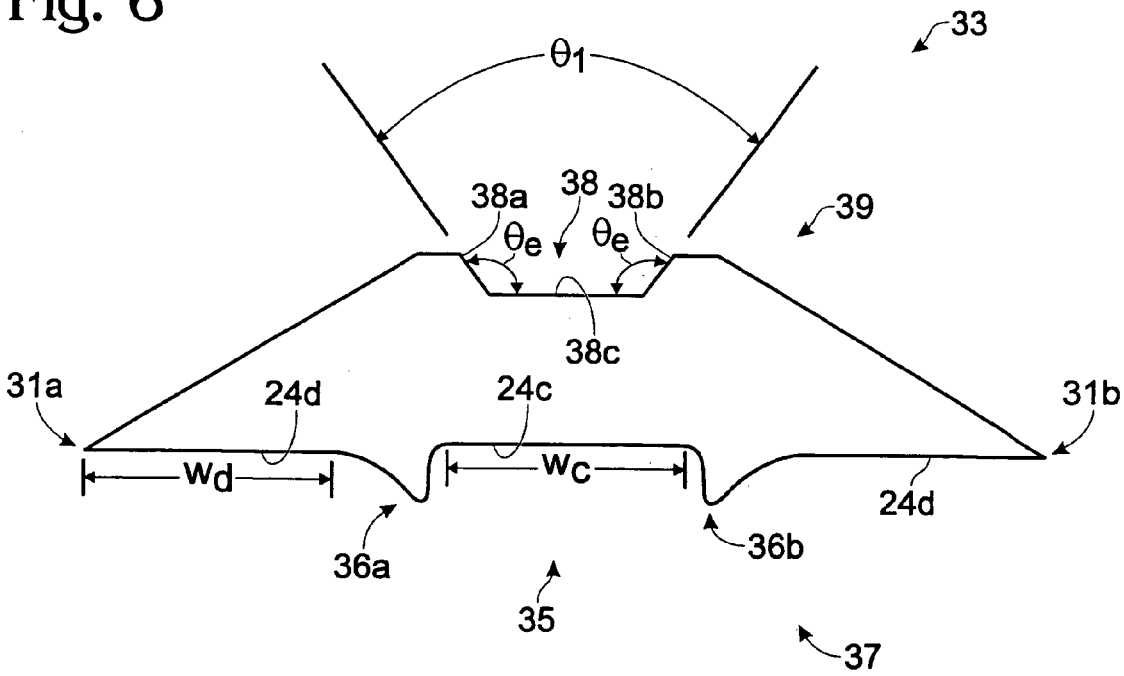
FIG. 6 is a cross-sectional view of a knife according to the present invention.

Now turning to FIG. 6, a cross-sectional view of a knife 33 according to the present invention is shown. The knife is elongate with an elongate axis that is perpendicular to the plane of the Figure. The double-sided knife has two cutting edges 31*a*, 31*b*, and an interlocking feature 35 comprising two deflector ridges 36*a*, 36*b* on a front side 37 of the knife, and an interlocking feature 38 on a back side 39 of the knife, which joins the front side 37 at the cutting edges 31*a* and 31*b*. The interlocking feature 35 is adapted to mate with a corresponding feature in the counterknife, to index the knife to the counterknife, and the interlocking feature 38 is adapted to mate with a corresponding feature in the outer clamping member, to index the knife to the outer clamping member. The interlocking features may serve additional functions, as do the deflector ridges.

Figure 7:
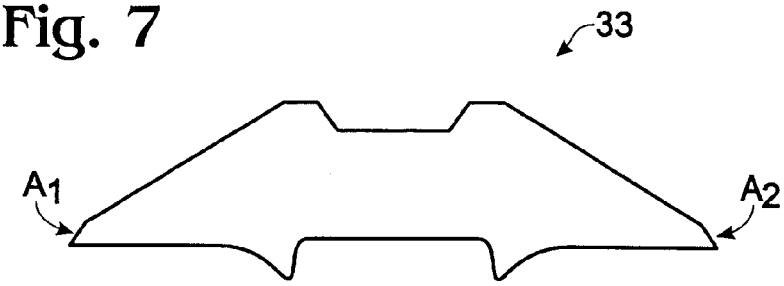
FIG. 7 is a cross-sectional view of an alternative embodiment of a knife according to the present invention.

The interlocking feature 38 includes opposed planar surfaces 38*a* and 38*b* defining a positive (i.e., non-zero) included angle $\theta_1$ reference to which is made below. The planar surfaces 38*a* and 38*b* are spaced apart by an intermediating planar surface 38*c* and make equal angles θe with respect to the intermediating planar surface. FIG. 7 shows an alternative knife 33 having the same features that is "top ground" at $A_1$ and $A_2$.

Figure 8:
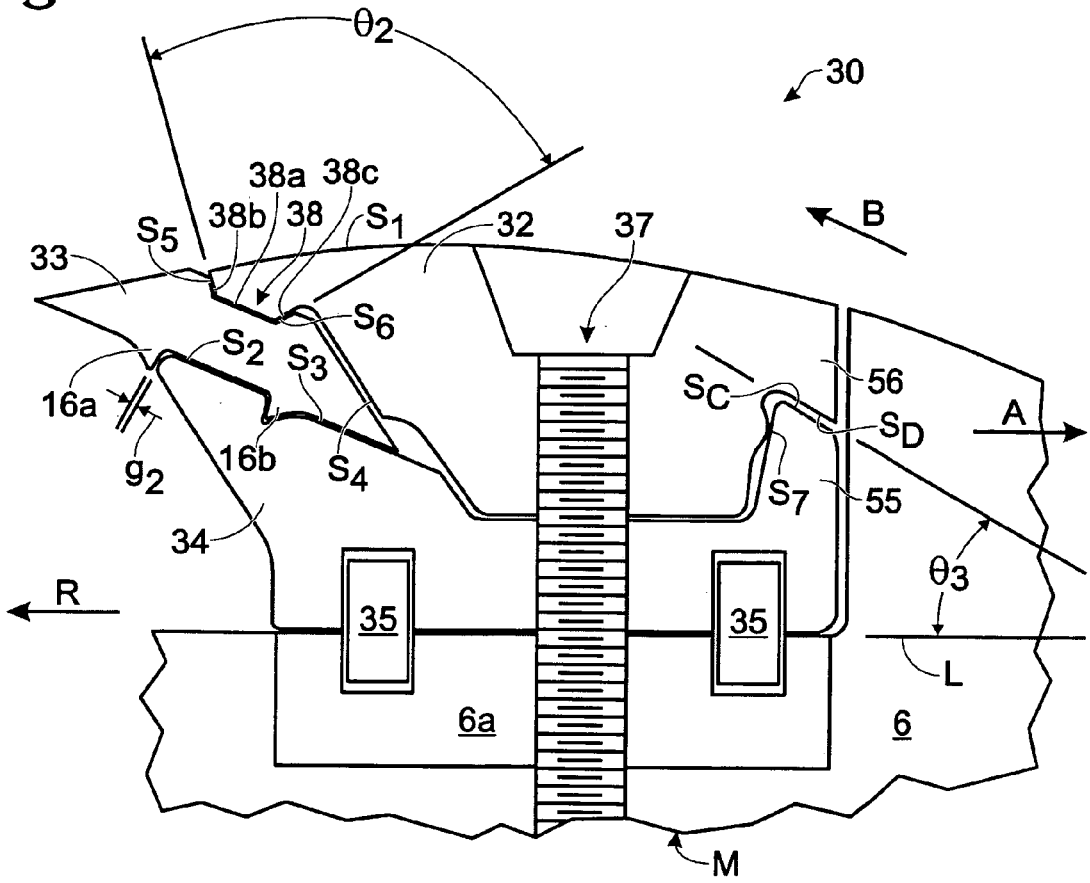
FIG. 8 is a cross-sectional view of a knife assembly according to the present invention including the knife of FIG. 6.

Turning to FIG. 8, a knife assembly 30 according to the present invention including the knife 33 is shown. The knife assembly 30 has an outer clamping member 32 with an outer surface $S_1$ tracing an arcuate line. The surface S is adapted to constrain the article of wood, as the knife assembly travels along its arc of rotation, by pressing on the freshly cut surface of the wood, to keep the article of wood from bucking the cutting apparatus. Such a shape for the surface $S_1$ is disclosed in the assignee's U.S. Pat. No. 6,164,352.

The knife assembly 30 further includes a counterknife 34 for cooperating with the outer clamping member 32 to clamp the knife. A bolt (not shown) extends through a bolt-hole 37 through both the outer clamping member and the counterknife into the disc 6, or alternatively, into a block 6*a* in the disc (as shown). In addition, one or more pins 35 are preferably provided in corresponding receiving holes in the counterknife 34 and the disc 6 (or block 6*a*) to index the counterknife to the disc.

Contact with the knife 33 is controlled by five control surfaces $S_2$–$S_7$, shown exaggerated for purposes of illustration. The control surface $S_2$ is provided by the counterknife 34 between the deflector ridges 16 of the knife 33 and, unlike the land 24*a* (FIG. 5), provides substantially "full contact" over the area there between. Particularly, referring to FIG. 6, the knife has a surface 24*c* that has a width $w_c$, and the control surface $S_2$ makes full contact with the surface 24*c* over substantially the entire width $w_c$.

The control surface $S_3$ of the counterknife corresponds to the land 24*b* (FIG. 5). Again referring to FIG. 6, the knife has two surfaces 24*d* adjacent the respective deflector ridges, the surfaces 24*d* having widths $w_d$. Unlike the prior art knife's contact with the land 24*b* (FIG. 5), the control surface $S_3$ makes contact with the unexposed surface 24*d* of the knife 33 as shown in FIG. 7 over a substantial area, e.g., at least 50% of the width $w_d$, rather than confining contact to a single point of contact. Preferably, the surfaces 24*c*, 24*d*, $S_2$ and $S_3$ are all planar; however, this is not essential.

The control surfaces $S_4$–$S_7$ are provided by the outer clamping member 32. The control surface $S_4$ is a "stop" for movement of the knife in the circumferential direction "A." The control surfaces $S_5$ and $S_6$ act as wedges within the recess 38 of the knife 33. Particularly, the control surfaces $S_5$ and $S_6$ bear against the side surfaces 38*b* and 38*c*, respectively, of the recess 38. Wedging action is preferably provided by ensuring that the included angle $\theta_2$ defined by the control surfaces $S_5$ and $S_6$ (FIG. 7) is slightly greater than the corresponding angle $\theta_1$ defined by the surfaces 38*b* and 38*c*. Exemplary values for $\theta_1$ and $\theta_2$, respectively, are 70 and 72 degrees, although the angles can range from about 50–90 degrees and the difference between the angles can range from about ¼ to 7 degrees, and more preferably about 1–4 degrees.

The remaining control surface $S_7$ engages the counterknife 34 to lock the counterknife to the outer clamping member and prevent movement of the outer clamping member with respect to the counterknife in the direction "A."

In addition to the control surfaces $S_2$–$S_7$, the invention may advantageously provide a gap "g" within the range of about 0.001" to 0.008", and more preferably about 0.005", between the counterknife 34 and the exposed deflector ridge, e.g., 16*a*. The gap is small enough to prevent significant loading of wood chip material, yet ensures that the load exerted on the knife 33 by the outer clamping member 32 is borne by the control surfaces $S_2$ and $S_3$.

The counterknife 34 includes a heel portion 55 and the outer clamping member 32 has a corresponding heel portion 56. By contrast to the heel portions 45 and 46 of the prior art, the heel portions 55 and 56 of the present invention are not spaced apart by virtue of the contact between the counterknife and the outer clamping member at the control surface $S_7$. Opposed surfaces $S_C$ and $S_D$ of the heel portions are provided at an angle $\theta_3$ according to the invention. The angle $\theta_3$ is taken with respect to a line "L" that lies in the direction "R" of travel of the knife, which is typically the arc of rotation of the apparatus (the disc is drawn as though it has zero curvature in FIG. 8) at the place of attachment of the assembly 30 thereto, i.e., at the mounting point "M." The angle $\theta_3$ therefore defines the direction "B" shown. Relative movement of the outer clamping member 32 with respect to the counterknife in directions having angles less than $\theta_3$ is prevented by the heel portions 55 and 56. Preferably, the angle $\theta_3$ ranges from about 20–40 degrees, and more preferably the angle is about 30 degrees.

The heel portion 55 provides a backstop for the corresponding heel portion 56. Particularly, the control surface $S_7$ of the heel portion 56 abuts the heel portion 55 and thereby prevents movement of the outer clamping member 32, with respect to the counterknife 34, in the direction "A," which is opposite to the direction of rotation "R" of the disc.

Figure 9:
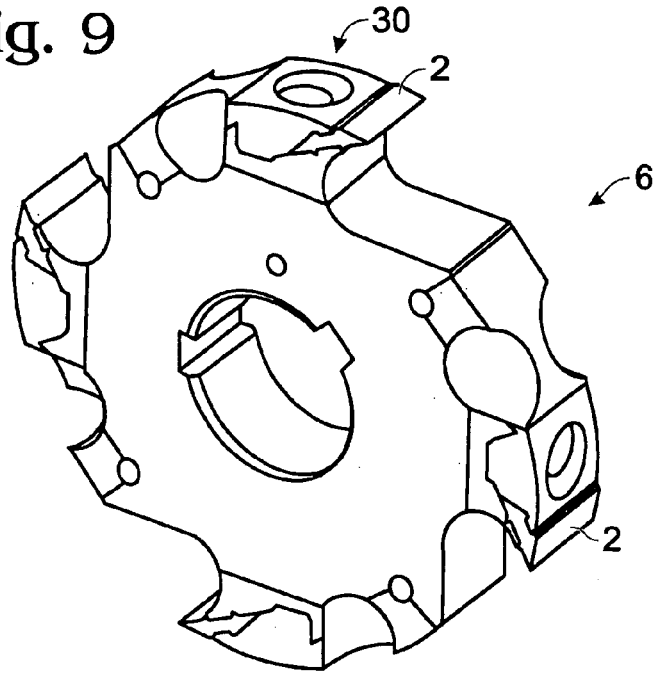
FIG. 9 is a pictorial view of a single chipping or cutting disc with a knife assembly according to the present invention attached.
Figure 10:
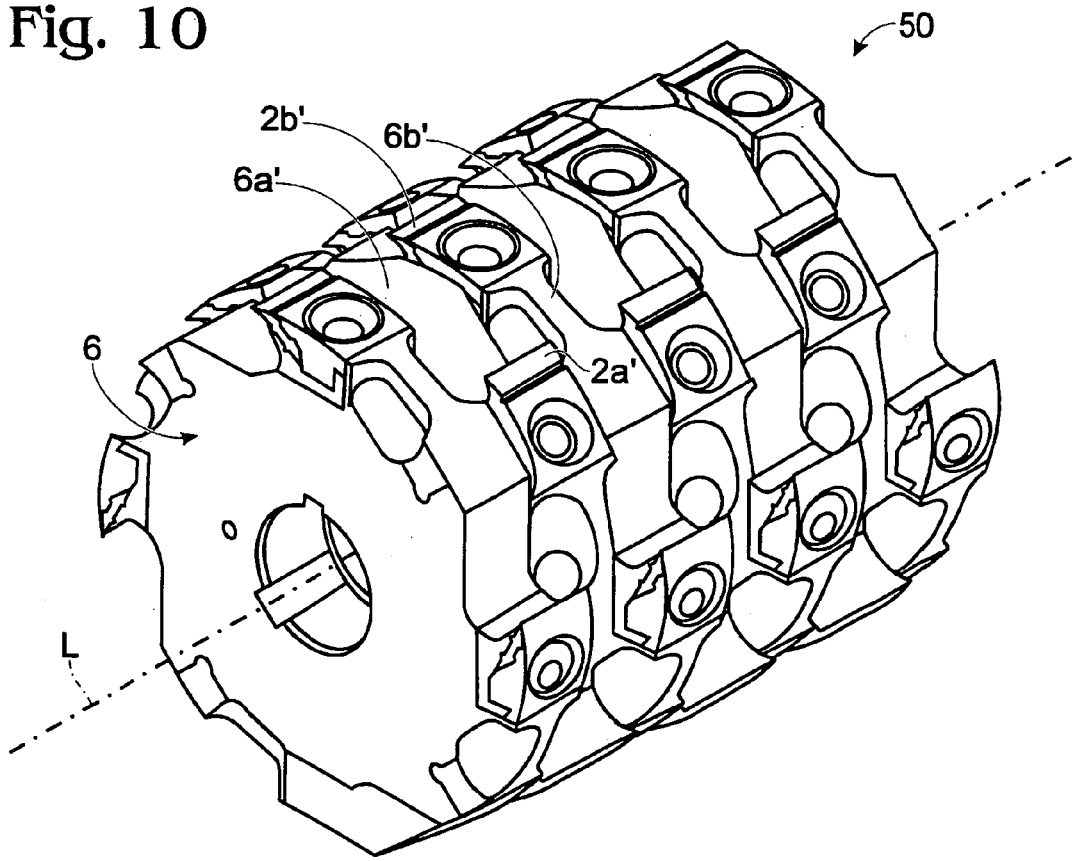
FIG. 10 is a pictorial view of a head assembly according to the present invention including a plurality of stacked discs of the type shown in FIG. 9.
Figure 11:
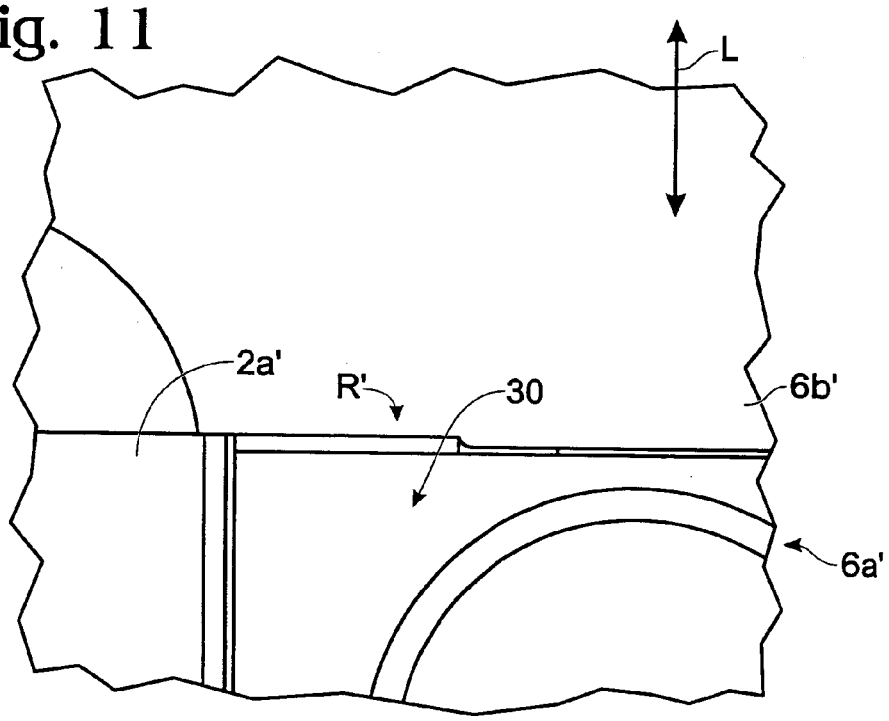
FIG. 11 is a plan view of a portion of the head assembly of FIG. 10, showing interlocking of two adjacent disc segments.

FIG. 10 illustrates a further stabilizing aspect of the present invention. A number of discs 6 (see FIG. 9) may be stacked as disc segments in a head assembly 50. The disc segments 6 are angularly staggered with respect to the axis of rotation L so that the knives of adjacent disc segments, such as the knives 2*a*' and 2*b*' respectively of the disc segments 6*a*' and 6*b*', are not adjacent one another. Referring to FIG. 11, the knives are slightly wider, in the direction of the axis L, than the disc segments, and the disc segments are relieved at R'slightly to receive overhanging portions of the knives of adjacent disc segments, so that the disc segments interlock with one another. Controlling the amount of this relief laterally constrains the knives and stabilizes their disposition in the disc segments.

Figure 12:
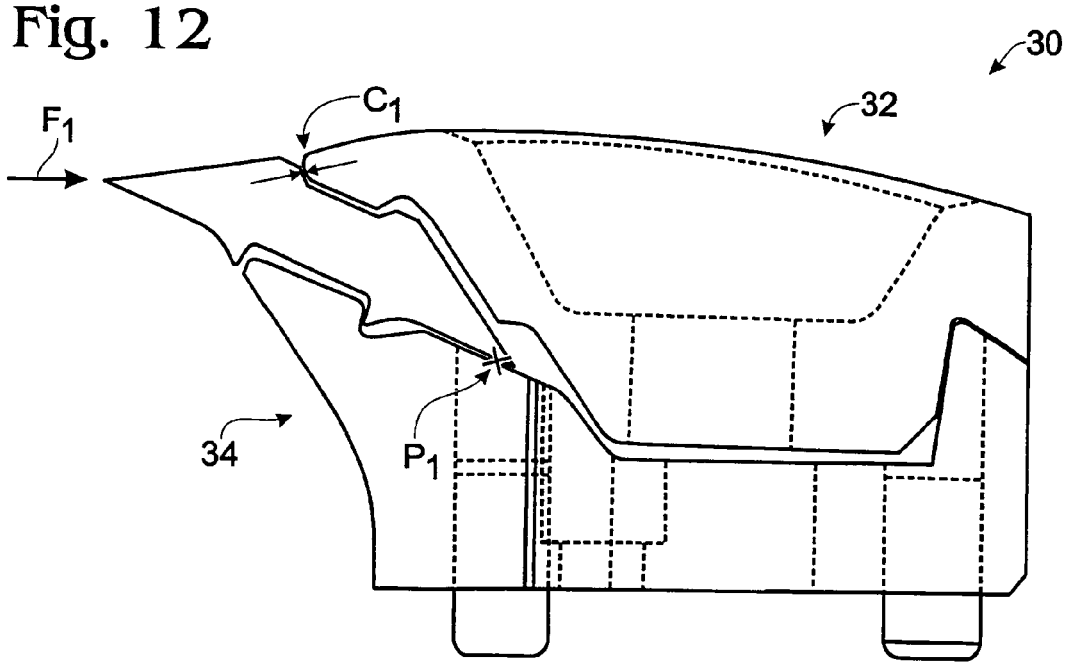
FIG. 12 is a cross-sectional view of a knife assembly according to the present invention shown with a first applied cutting force vector and with reactions shown exaggerated.
Figure 13:
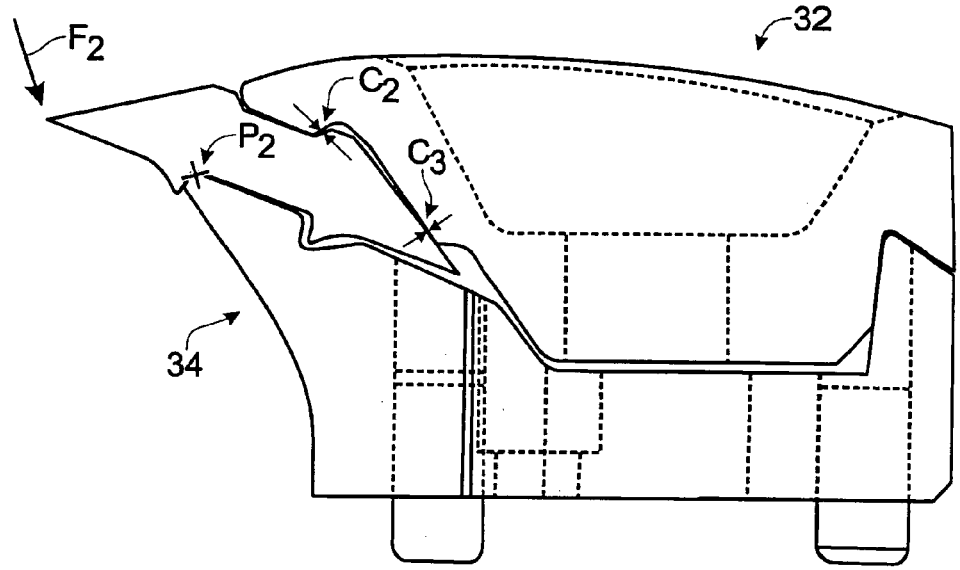
FIG. 13 is a cross-sectional view of the knife assembly of FIG. 12 with a second applied cutting force vector and with reactions shown exaggerated.

FIGS. 12 and 13 illustrate, respectively, the assembly of FIG. 8 wherein the knife 33 is subject to two different force vectors $F_1$ and $F_2$. The forces F are applied by the log or lumber as it is cut or chipped. Movement of the knife in response to each of the forces F is controlled by the aforedescribed features. The knife pivots between the outer clamping member 32 and the counterknife 34 about pivot point $P_1$ in response to the force $F_1$ in FIG. 12. The knife is restrained at $C_1$ at the surface 38*b* of the knife by the control surface $S_5$ (see FIG. 8) of the outer clamping member. The knife also pivots about point $P_2$ in response to the force $F_2$ in FIG. 13 and is restrained at $C_2$ and $C_3$. The knife is restrained at $C_2$ at the surface 38*c* of the knife by the control surface $S_6$ (FIG. 8) of the outer clamping member, and is restrained at $C_3$ at the outer surface 39 (FIG. 6) of the knife by the control surface $S_4$ (FIG. 8) of the outer clamping member.

Figure 14:
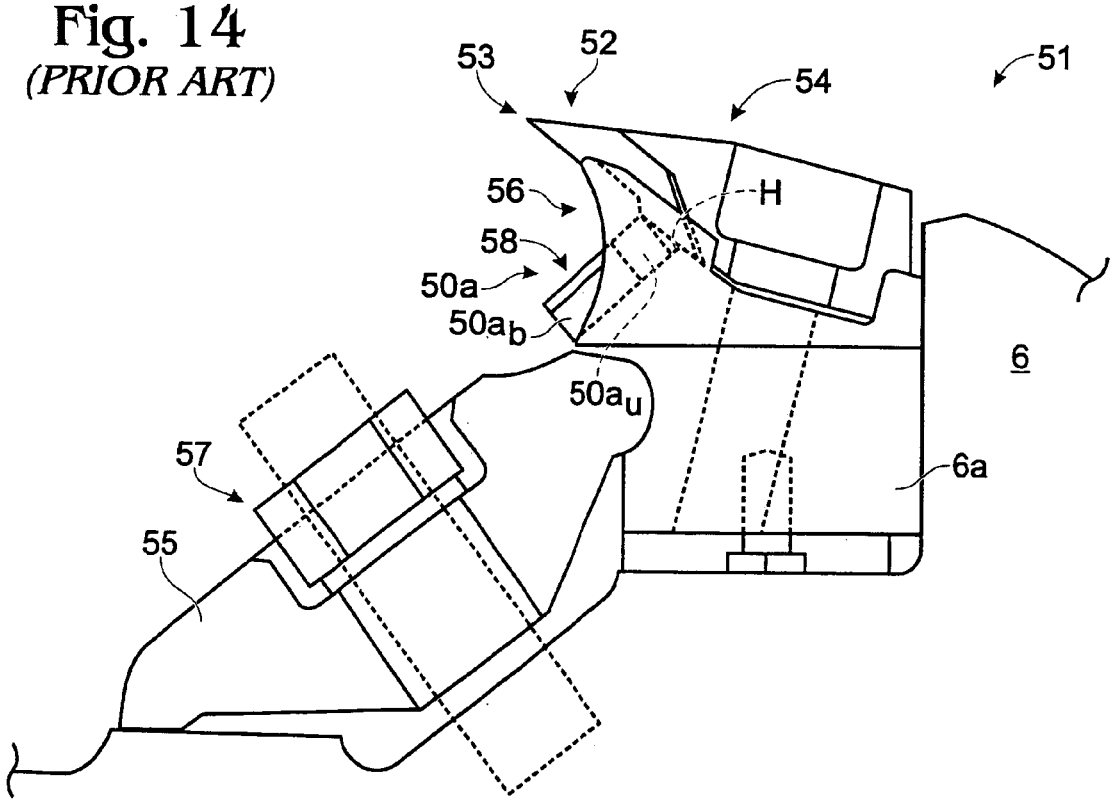
Fig. 14 (PRIOR ART)
FIG. 14 is a cross-sectional view of a knife assembly mounted to a chipping or cutting disc and incorporating a prior art "splitter."

Turning to FIG. 14, a prior art "splitter" 50*a* is shown for use in a knife assembly 51 comprising a knife 52, an outer clamping member 54 and a counterknife 56. The splitter is disposed downstream of the knife and is used to split wood chips cut by the knife. FIG. 14 shows, in addition to a block 6*a* in the disc 6 for receiving the knife assembly 51, a clamp 55 fastened to the disc 6 by a bolt 57 that engages the block 6*a*, a feature that may be employed in connection with the present invention as well. The splitter has a splitting edge 58 that is formed from a plate-like body portion $\mathbf{50}a_b$ that fits into a cavity or way in the counterknife 56, while an upper portion 50$a_u$ of the splitter is cylindrical and fits in a hole "H" extending into the counterknife 56. Replacing the splitter requires withdrawing the splitter through the hole "H" which is somewhat inconvenient. It is also recognized herein that the geometry of the splitter 50*a* and the splitting edge 58 are limiting in the range of positions and angles of the splitting edge 58 that can be made available with respect to the cutting edge 53 of the knife 52, and that this lack of flexibility may result in a failure to achieve functionality.

Figure 16:
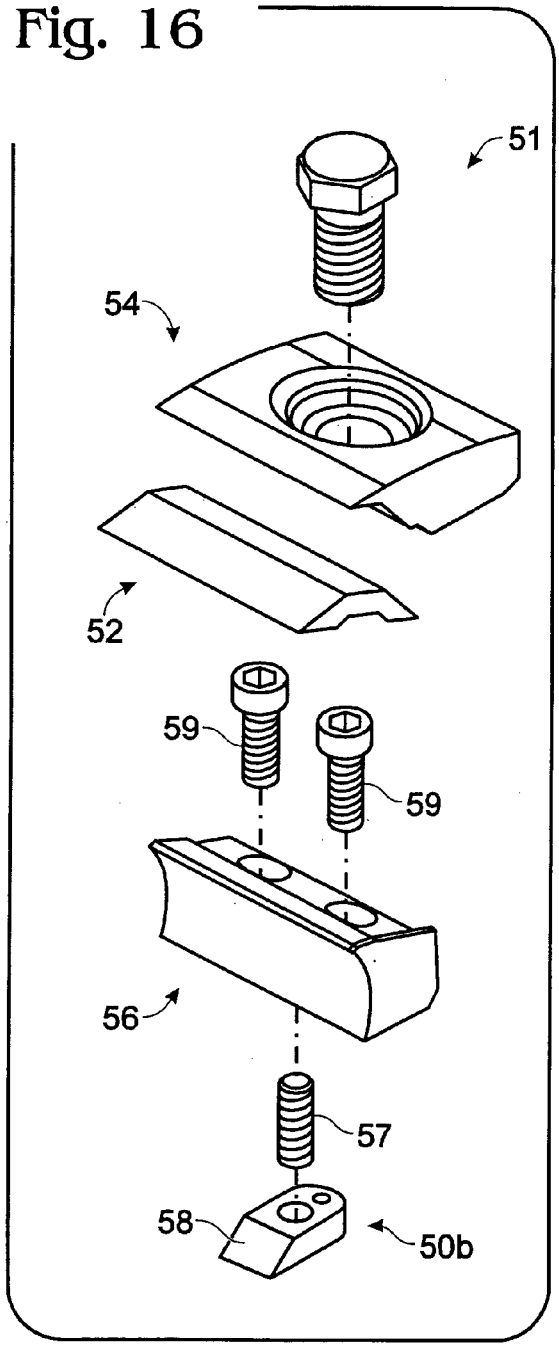
FIG. 16 is an exploded view of the knife assembly and splitter combination of FIG. 15.
Figure 15:
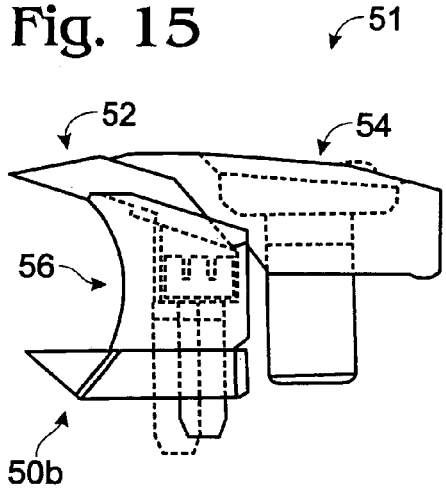
FIG. 15 is a side elevation of a knife assembly incorporating an alternative embodiment of a prior art splitter.

Turning to FIGS. 15 and 16, a second prior art splitter 50*b* is shown for use in the knife assembly 51. In this embodiment, the splitter is mounted to the counterknife 56, here between the counterknife and the disc 6 (or the block 6*a*). The splitter is held in place by clamping bolts 59 bearing on the counterknife 56, and is located with a dowel pin 57. It is recognized herein that the splitter 50*b* being disposed underneath the counterknife is inherently limited in positioning the splitting edge 58 in proximity to the cutting edge of the knife.

Turning now to FIGS. 17–20, a splitter 60 according to the present invention is shown for use with the knife assembly 30 of FIG. 8. The splitter is shown in FIG. 17. It is shown attached to the counterknife in FIG. 19, and with a lower portion of the counterknife removed in FIG. 20.

Figure 21:
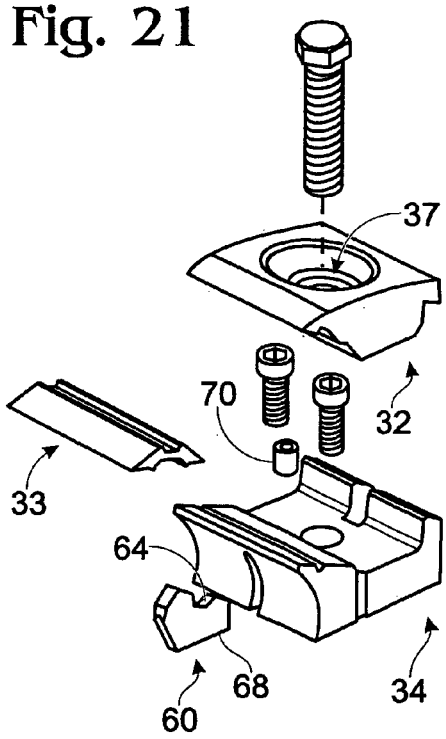
FIG. 21 is an exploded view of a knife assembly according to the present invention incorporating a second embodiment of a splitter according to the present invention.

The splitter 60 is received in a cavity or way 61 (FIG. 19) in the counterknife via a non-interference fit, so that the splitter can be installed and removed from the counterknife, through the way 61, by hand. The splitter has a beveled splitting portion 62 that projects outwardly from the counterknife 34 into the stream of wood chips cut by the knife 33 indicated by the arrow in FIG. 21. The splitting portion 62 has a knife-like edge 63 resulting from beveling the splitter to create, preferably for ease of manufacturing, flat bevel portions 65*a* and 65*b* (FIG. 17). The knife-like edge is preferably convexly curved such as shown. A flat bevel portion 65*c* forming an underside of the splitting portion 62 is shown in FIG. 19 may also be provided to provide support for the knife edge 63.

Referring to FIG. 20, the splitter 60 is held in the way 61 of the counterknife by a set-screw 70. The set-screw is adapted to bear on a clamping surface 64 (FIG. 17) of the splitter to hold the splitter in place. A bottom surface 68 of the splitter is adapted to rest on the disc 6 (or the block 6*a*) when the knife assembly 30 is mounted on the disc. The bottom surface 68 may include an aperture 66 for clearing the pin 35, the pin 35 may be moved out of the way of the splitter as in FIG. 20 (where it is disposed behind the splitter with respect to the cross-sectional plane), or the splitter may terminate short of the pin 35 as in the embodiment shown in FIG. 21.

The curvilinear splitting edge 63 provides increased control in locating the splitting edge at any desired position and angle with respect to the cutting edge of the knife. The splitter is also easily removable for repair or replacement by virtue of its being adapted to be removed and installed through the way 61. In addition, the splitter is preferably bilaterally symmetric about an axis of symmetry "SY" as shown in FIG. 17 and in that form includes dual splitting portions 62 and corresponding knife-like edges 63. This provides the outstanding advantage that, when the exposed splitting edge becomes dulled during use, the splitter can be easily removed from the counterknife 34 simply by loosening the set-screw 70, removing the splitter from the knife assembly through the way 61, rotating the splitter 180 degrees about the axis SY, and reinstalling the splitter in the counterknife 34 through the way 61 to provide a fresh splitting edge.

It is to be recognized that, while a specific wood chipping or cutting knife assembly providing improved knife stability has been shown and described as preferred, other configurations and methods could be utilized, in addition to configurations and methods already mentioned, without departing from the principles of the invention.

The terms and expressions which have been employed in the foregoing specification are used therein as terms of description and not of limitation, and there is no intention of the use of such terms and expressions to exclude equivalents of the features shown and described or portions thereof, it being recognized that the scope of the invention is defined and limited only by the claims which follow.

The invention claimed is:

1. A knife assembly for a wood cutting apparatus, comprising:

a knife having a cutting edge and opposing front and back sides extending from said cutting edge, said front side having a first interlocking feature and said back side having a second interlocking feature; and an outer clamping member adapted to receive said back side of said knife, said outer clamping member having a third interlocking feature for interlocking with said second interlocking feature to index said knife to said outer clamping member, wherein said second interlocking feature includes opposed first plane surfaces defining a first positive angle therebetween, and said third interlocking feature includes corresponding opposed second plane surfaces defining a second positive angle that is slightly greater than said first positive angle, for wedging said outer clamping member in said second interlocking feature.

2. The knife assembly of claim 1, further comprising a counterknife adapted to receive said front side of said knife and to mount to the apparatus, said counterknife having a fourth interlocking feature for interlocking with said first interlocking feature to index said knife to said counterknife, said outer clamping member adapted to mount to said counterknife.

3. The knife assembly of claim 2, wherein the difference between said first positive angle and said second positive angle is in the range of about ¼–7 degrees.

4. The knife assembly of claim 2, wherein said first angle is about 70 degrees.

5. The knife assembly of claim 4, wherein said second angle is about 72 degrees.

6. The knife assembly of claim 1, wherein the difference between said first positive angle and said second positive angle is in the range of about ¼–7 degrees.

7. The knife assembly of claim 1, wherein said first angle is about 70 degrees.

8. The knife assembly of claim 7, wherein said second angle is about 72 degrees.

9. The knife assembly of claim 1, wherein said opposed first plane surfaces are spaced apart by an intermediating plane surface, said first plane surfaces defining a first positive angle therebetween, said first plane surfaces defining respective equal angles with respect to said intermediating plane surface.

10. The knife assembly of claim 9, wherein the difference between said first positive angle and said second positive angle is in the range of about ¼–7 degrees.

11. The knife assembly of claim 9, wherein said first angle is about 70 degrees.

12. The knife assembly of claim 11, wherein said second angle is about 72 degrees.

13. A knife assembly for a wood cutting apparatus, comprising:

a knife having an elongate axis and comprising two spaced apart cutting edges parallel to said elongate axis and opposing front and back sides extending between said cutting edges, said front side having a pair of spaced apart deflector ridges extending parallel to said elongate axis and outwardly from said front side;

a counterknife adapted to receive said front side of said knife, said counterknife having an interlocking feature providing for contact with said knife between said deflector ridges, to index said knife to said counterknife, said knife including respective planar surfaces adjacent each of said deflector ridges extending out to the corresponding cutting edges, wherein said counterknife includes a planar surface adapted to make contact with a selected one of said planar surfaces of said knife; and an outer clamping member adapted to receive said back side of said knife, said outer clamping member having an interlocking feature for interlocking with a corresponding interlocking feature of said back side of said knife to index said knife to said outer clamping member so that, in cooperation with said contact, a small gap exists between an exposed one of said deflector ridges and said counterknife, said gap ranging from about 0.001"–0.008".

14. A wood cutting apparatus, comprising:

a rotating member for rotating about an axis of rotation;

a knife having a cutting edge and opposing front and back sides extending from said cutting edge, said front side having a first interlocking feature and said back side having a second interlocking feature;

an outer clamping member adapted to receive said back side of said knife, said outer clamping member having a third interlocking feature for interlocking with said second interlocking feature to index said knife to said outer clamping member, and said second interlocking feature includes opposed first plane surfaces defining a first positive angle therebetween, wherein said third interlocking feature includes corresponding opposed second plane surfaces defining a second positive angle that is slightly greater than said first positive angle, for wedging said outer clamping member in said second interlocking feature; and a counterknife adapted to receive said front side of said knife and to mount to said rotating member, said counterknife having a fourth interlocking feature for interlocking with said first interlocking feature to index said knife to said counterknife, said outer clamping member adapted to mount to said counterknife.

* * * * *